US006008446A

United States Patent [19]

Van Buskirk et al.

[11] Patent Number: 6,008,446

[45] Date of Patent: Dec. 28, 1999

[54] SYNTHESIZER SYSTEM UTILIZING MASS STORAGE DEVICES FOR REAL TIME, LOW LATENCY ACCESS OF MUSICAL INSTRUMENT DIGITAL SAMPLES

[75] Inventors: James E. Van Buskirk, Cedar Park; Joseph A. Bibbo, Austin, both of Tex.

[73] Assignee: Conexant Systems, Inc., Newport Beach, Calif.

[21] Appl. No.: 09/095,519

[22] Filed: Jun. 10, 1998

Related U.S. Application Data

[63] Continuation of application No. 08/863,829, May 27, 1997, Pat. No. 5,811,706.

[51] Int. Cl.[6] ..... G10H 1/02; G10H 7/00

[52] U.S. Cl. ..... 84/603; 84/626; 84/639; 84/642; 84/645

[58] Field of Search ..... 84/601–607, 645, 84/609–614, 634–638, 622–633

[56] References Cited

U.S. PATENT DOCUMENTS

| | | | |
|---|---|---|---|
| 5,262,581 | 11/1993 | Sharp | 84/603 |
| 5,284,080 | 2/1994 | Noguchi et al. | 84/604 |
| 5,463,183 | 10/1995 | Konno | 84/604 |
| 5,489,746 | 2/1996 | Suzuki et al. | 84/602 |
| 5,525,748 | 6/1996 | Kuribayashi et al. | 84/602 |
| 5,596,159 | 1/1997 | O'Connell | 84/645 X |
| 5,698,802 | 12/1997 | Kamiya | 84/604 |
| 5,753,841 | 5/1998 | Hewitt | 84/604 |
| 5,763,801 | 6/1998 | Gulick | 84/604 |
| 5,835,944 | 11/1998 | Lahti et al. | 84/604 X |

*Primary Examiner*—Stanley J. Witkowski

*Attorney, Agent, or Firm*—Akin, Gump, Strauss, Hauer & Feld, L.L.P.

[57] ABSTRACT

A synthesizer system includes a CPU and host memory operating a software routine. The software routine stores a first part of each waveform signal in a sample pool of host memory and provides remaining portions of selected musical sounds from the hard drive to a stream cell array without an audio perceivable delay. The synthesizer system utilizes a caching system which allows low cost, high storage devices to be utilized in an audio synthesizer system. MIDI control signals are provided to an audio processor for selecting appropriate digital waveform signals.

61 Claims, 4 Drawing Sheets

SYNTHESIZER SYSTEM UTILIZING MASS STORAGE DEVICES FOR REAL TIME, LOW LATENCY ACCESS OF MUSICAL INSTRUMENT DIGITAL SAMPLES

CROSS REFERENCE TO RELATED APPLICATIONS

The present application is a continuation of U.S. Ser. No. 08/863,829, filed May 27, 1997 (now U.S. Pat. No. 5,811, 706), by Van Buskirk, et al, and assigned to the Assignee of the present invention.

FIELD OF THE INVENTION

The present invention is related generally to digital sound synthesizer systems. More particularly, the present invention is related to a sound synthesizer system utilizing mass storage media or devices.

BACKGROUND OF THE INVENTION

Digital synthesizers or other electronic systems generally create sound or music and can be utilized as an electronic musical instrument or electronic sound machine. Digital synthesizers are ordinarily arranged to accept input signals from a musician or operator interface and produce digital output signals representing analog signals in the audio frequency range. The interface can provide keystroke signals, mouse signals, touch pad signals, or keyboard signals representing the musician's action.

The digital output signals from the digital synthesizer can be converted to analog signals and directed to equipment such as a loudspeaker, tape recorder, mixer, or other device and reproduced in the form of sound. The digital synthesizer can be arranged to provide output signals simulating the sounds of conventional, known musical instruments. Alternatively, the synthesizer may be arranged to simulate sounds which would be emitted by a theoretical instrument having predetermined characteristics different from those of any conventional, known musical instruments.

Music and sound synthesis is a formidable technical task. Real musical instruments produce complex blends of many different frequencies imparting what is commonly referred to as "tone color" to the sound. For example, percussion sounds such as those made by a drum, cymbal or the like are an aperiodic function which cannot fully be described by any simple mathematical expression. Accordingly, the production or synthesis of digital signals representing sounds as rich and complex as those of a real instrument is a formidable digital signal, processing and sampling task. Moreover, the synthesizer must respond to the nuances of the musician's manipulation of the interface. For example, a snare drum has many different audio characteristics when played in various locations such as toward the center of the drum, toward the rim or on the rim. Additionally, the audio characteristics of the snare drum also vary with the striking force, playing technique and stylistic inflection of the musician.

A large enough sample database for each of these characteristics and combinations thereof (facilitated by huge sampling capability) is needed to adequately capture the behavior of the instrument. By having a large enough waveform database, more realistic and expressive synthesis can be achieved. Many synthesizers using waveform sampling technology are used extensively in the music and multimedia fields for their ability to create musical sounds that closely emulate the sound of a musical instrument.

Prior synthesizer systems often utilize a Musical Instrument Digital Interface (MIDI) to control digital synthesizers. The MIDI interface creates control signals or MIDI control data. The MIDI control data represents music events such as the occurrence of specific notes (e.g., Middle C, to be realized by a specific musical sound, e.g., piano, horn or drum).

Conventional synthesizer systems utilize a large solid state memory which stores the digital waveform signals representing the real sound of each note played on a particular instrument. The memory can be a static random access memory (SRAM), a dynamic Ram (DRAM) or a read only memory (ROM). When the musician actuates a key or other interface, the appropriate waveform signal is selected depending on the key activated and the intensity of the strike. The waveform signal is converted into an analog output signal. The digital waveform signal can be combined with other notes which are simultaneously being played before being converted to the analog output signal.

In this arrangement, the synthesizer in effect merely plays back digital recordings of individual sounds or notes. Each waveform signal is stored as a series of individual data words, each representing a single sample of the waveform at a particular time. To achieve acceptable fidelity, any such stored waveform signal must include thousands of samples per second in stored sound. The memory required to store each waveform signal is substantial, and the solid state memory required to store all the required waveform signals is accordingly extremely large. The solid state memory is required because its speed allows an essentially real time playback (e.g., no audio perceivable delay). The high cost per unit of sound samples storage of any type of solid state memory has somewhat prohibited the use of large amounts of digital waveform signals for accurate representation of musical instruments and all their nuances. A major limitation of current synthesizers is the lack of sufficient memory to store the entire sample of a wide range of sounds associated with musical instruments (e.g., due to cost).

To reduce the memory requirements, synthesizer systems have used techniques to more efficiently store instrument samples. These techniques generally result in lower quality sound generation. The technique of "looping" reuses samples of the sound. By replicating and reusing groups of samples, the overall memory requirement is reduced. Other techniques store samples in a compressed state in solid state memory. However, these systems require significant CPU power to implement the decompression algorithm, Also, the decompression algorithm can be lossy and suffer audio quality degradation.

Other prior art synthesizer systems have utilized hard disks or other mass storage devices from which the instrument samples are loaded into a solid state memory prior to musical tone generation or playing the instrument. However, these systems still require large amounts of solid state memory because all of the digital waveform signals for the instrument must be loaded into the solid state memory before playing.

Some synthesizer systems have utilized ROM or other types of less expensive, slower solid state memory to store the digital waveform signals. These synthesizers employ a data caching technique to move the waveform signals from the slower ROM to a high speed RAM such as a SRAM for tone generation. Nonetheless, the slower ROM and high speed RAM add significant cost to the synthesizer.

Other prior art systems store only one or several waveforms representing each musical instrument. These waveforms are then adjusted by digital signal processing techniques or other electronic techniques (e.g., non-linear distortion) to reflect frequency and amplitude changes associated with different musical characteristics as indicated by the MIDI control data. For example, the frequency and amplitude of a sample waveform representing middle C of a piano can be adjusted to synthesize a different piano note and volume. However, these types of synthesizers are unable to produce the complex blends or tone color to a high enough fidelity for the musically trained ear. In another example, some systems utilize digital filters to adjust the harmonic content of a particular note. However, these systems require significant CPU power and can suffer audio quality degradation.

Thus, there is a need for a music synthesizer which can store large amounts of musical samples without utilizing substantial amounts of expensive solid state memory. Further still, there is a need for a music synthesizer which can utilize a mass storage device and yet provide a real time production of musical tones.

SUMMARY OF THE INVENTION

The present invention relates to an audio processor for providing a digital output signal representative of a sound at an output. The audio processor includes a mass storage device input for receiving a plurality of digital waveform signals, a control input for receiving digital control signals, and a control circuit coupled to the control input and the mass storage device input. The digital control signals are indicative of at least one selected digital waveform signal of the digital waveform signals. The control circuit stores a first part of the digital waveform signals in a host memory. The control circuit provides from the host memory a first part of the selected digital waveform signal to the output in response to the digital control signals and subsequently provides a remaining part of the selected digital waveform signal from the mass storage device input to the output. The control circuit provides the remaining part of the selected digital waveform signal without a loss of continuity between the first part of the selected digital waveform signal and the remaining part of the selected digital waveform signal.

The present invention also relates to a digital synthesizer system including a mass storage device means for storing a plurality of digital waveform signals, a control input means for receiving a digital control signal, a host memory means for storing a first part for each of the digital waveform signals and a processor means for generating a digital sound signal at an output. Each of the digital waveform signals corresponds to a particular sound of a plurality of sounds. The digital control signal is indicative of a selected sound of the sounds. The processor means provides from the host memory the first part of the digital waveform signal corresponding to the selected sound to the output and provides a second part oaf the digital waveform signal corresponding to the selected sound from the mass storage device means to the output. The processor means utilizes a caching techniques to provide the second part to the output.

The present invention further relates to a memory architecture for a digital synthesizer system. The digital synthesizer system includes a mass storage device and a processor. The mass storage device stores a plurality of digital waveform signals. Each of the digital waveform signals corresponds to a particular sound of a plurality of sounds. The processor receives a digital control signal. The digital control signal is indicative of a selected sound of the sounds. The audio processor generates a digital sound signal at an output in response to the digital control signal. The processor provides a first part of the digital waveform signal corresponding to a selected sound to the output followed by the second part of the digital waveform signal corresponding to the selected sound from the mass storage device. The memory architecture includes a sample buffer and a stream buffer. The sample buffer stores a first part of each of the digital waveform signals. The stream buffer temporarily stores the second part of the digital waveform signal corresponding to the selected sound.

The present invention still further relates to a method of digitally synthesizing sounds in a synthesizer system. The synthesizer system includes a mass storage device, a host memory and a processor. The mass storage device stores a plurality of digital waveform signals. The processor has a digital control signal input and a digital output. The processor is coupled to the host memory and the mass storage device. The method includes downloading a first part for each of the digital waveform signals into the host memory, receiving a digital control signal on the digital control signal input, the digital control signal indicating a selected digital waveform signal of the digital waveform signals, providing the first part of the selected digital waveform signal from the host memory to the digital output, and providing a second part of the selected digital waveform signal from the mass storage device to the digital output. The first part and the second part are provided so there is no audio perceivable delay between the first part and the second part.

The present invention even further relates to a method of digitally synthesizing sounds in a synthesizer system. The synthesizer system includes a mass storage device, a host memory, and a processor. The mass storage device stores a plurality of digital waveform signals. Each of the digital waveform signals corresponds to a particular sound of a plurality of sounds. The first part for each of the digital waveform signals is stored in the host memory. The processor has a digital control signal input and a digital output. The processor is coupled to the host memory and the mass storage device. The method includes receiving a digital control signal on the digital control signal input, the digital control signal indicating a selected sound of the plurality of sounds, providing a first part of a digital waveform signal corresponding to the selected sound from the host memory to the digital output, and providing a second part of the digital waveform signal from the mass storage device to the digital output corresponding to the selected sound. The first part and the second part are provided so there is no loss of continuity between the first part and the second part.

The present invention also relates to an audio processor for providing a digital output signal representative of a sound and an output. The audio processor includes a mass storage device input for receiving a plurality of digital waveform signals, a sample pool for storing a first part of the digital waveform signals, a stream buffer, a stream engine coupled to the mass storage device input and to the stream buffer, and a synthesizer engine coupled to the stream buffer and the output. The stream engine provides a second part of the digital waveform signals from the mass storage device input to the stream buffer. The synthesizer engine provides the second part of the digital waveform signals from the stream buffer to the output.

According to one exemplary aspect of the present invention, a digital synthesizer stores a first part of a digital waveform signal in a host memory and caches the remaining parts of the digital waveform signal from a mass storage device. The digital music synthesizer preferably utilizes a hard disk drive as a storage device and is implemented in software which is run by a computer. The computer includes a central processing unit and host memory operating in a Windows®-based environment.

In another exemplary aspect of the present invention, the synthesizer system utilizes an audio processor configured in software. The audio processor includes a solid state sample pool, a stream engine, a synthesizer engine and a solid state stream buffer. The stream engine provides portions of the digital waveform samples or signals from a mass storage device to the stream buffer. The synthesizer engine provides the portions of digital waveform signals from the sample pool and the stream buffer to a digital output. The processor preferably responds to MIDI control signals to select particular digital waveform signals.

In yet another exemplary embodiment of the present invention, a memory architecture for a digital synthesizer utilizes a host memory which includes a sample pool and an array of stream cells. The sample pool stores a first part of each digital waveform signal stored on a hard drive. The sample pool includes an array of sample cells, each including a deck buffer and a control data buffer. Each cell of the array of stream cells preferably includes a deck buffer pointer, a stream buffer and a control data buffer. The deck buffer stores the first part of the waveform. The stream buffer is utilized to store subsequent parts of the waveform which are stored on the hard drive.

BRIEF DESCRIPTION OF THE DRAWINGS

Preferred embodiments of the invention will hereafter be described in conjunction with the appended drawings, wherein like numerals denote like elements, and.

DETAILED DESCRIPTION OF PREFERRED EXEMPLARY EMBODIMENTS OF THE PRESENT INVENTION

Figure 1:
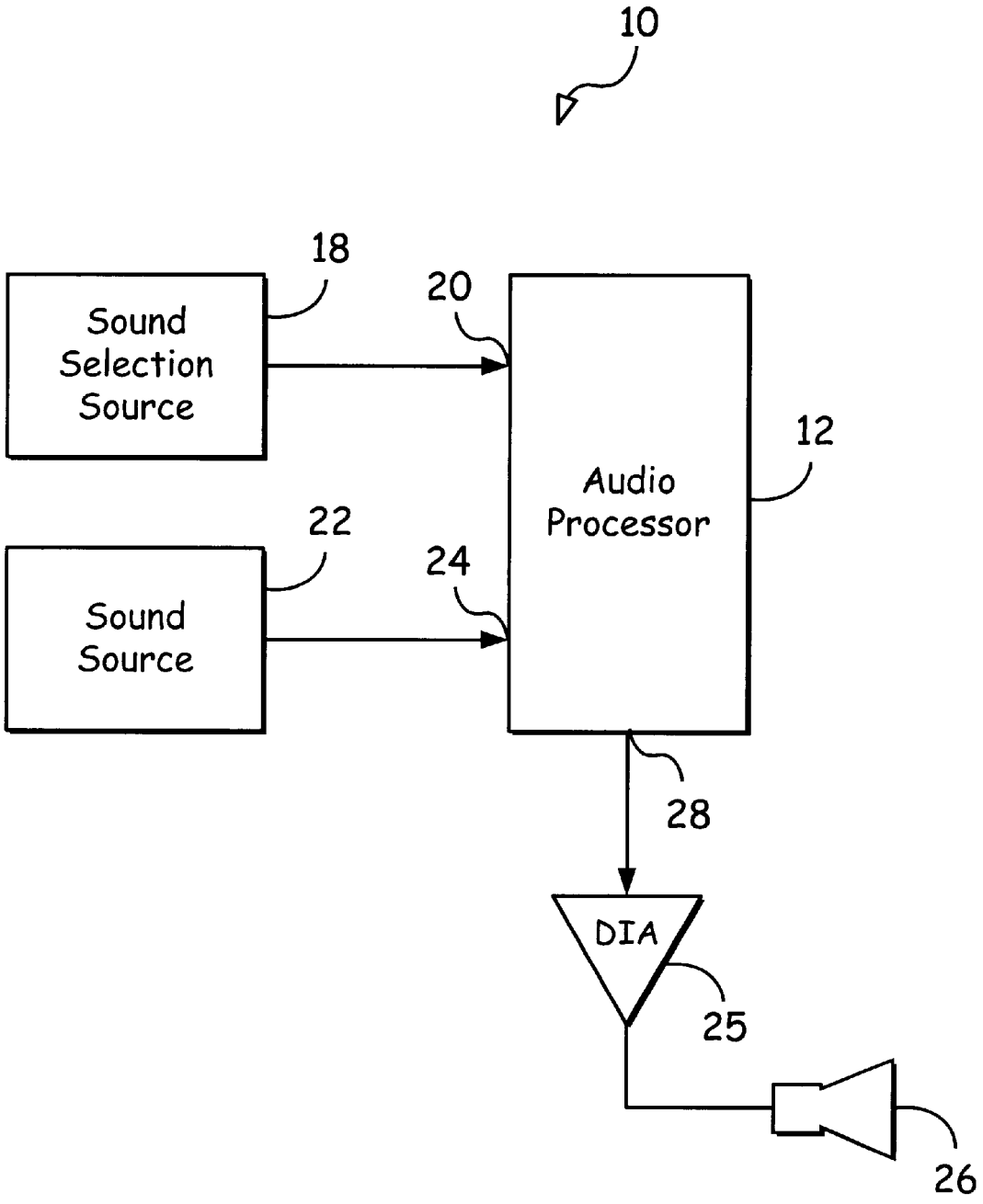
FIG. 1 is an exemplary block diagram of a digital sound synthesizer system including an audio processor in accordance with an exemplary embodiment of the present invention.

With reference to FIG. 1, a digital synthesizer system 10 includes an audio processor 12, a sound selection source 18, such as a MIDI source, a sound waveform source 22, such as a mass storage device for storing musical instrument digital waveform signals, a digital-to-analog (D/A) converter 25, and a speaker system 26. Audio processor 12 has a digital output 28 coupled to converter 25. Converter 25 has an output coupled to speaker system 26.

In operation, audio processor 12 receives digital control signals at a digital control input 20 from sound selection source 18 and digital samples or digital waveform signals at a mass storage device input 24 from digital waveform signal source 22. Audio processor 12 processes the digital control signals at input 20 and the digital waveform signals at input 24 to provide a digital output signal at output 28. The digital output signal is provided to converter 25 which provides an analog signal representative of the digital output signal to speaker system 26. As processor 12 receives a number of control signals at input 20, processor 12 can provide a combination, mixture or a number of different digital output signals at output 28, representative of the digital waveform signals indicated by the control signals at input 20. Speaker system 26 preferably generates sound or music representative of the digital output signal provided at output 28.

Converter 25 and speaker system 26 can be replaced with other devices coupled to digital output 28. For example, a mixer, recorder, digital storage device such as a hard disk drive, or other audio apparatus can be coupled to output 28 of processor 12. Speaker system 26 can be a stereo system including two or more speakers for providing a stereo production of sound indicated by the digital output signal which preferably represents stereo sound.

Sound selection source 18 can be any device for generating control signals which are most preferably MIDI data or control signals. MIDI control signals are well known in the art and represent music events such as the occurrence of a specific musical note, e.g., middle C, to be realized by a specific musical sound, e.g., piano, horn, drum or other device. Alternatively, audio processor 12 may be utilized with a different type of sound selection source 18 which provides control signals to input 20.

Sound selection source 18 can be a mouse interface, piano keyboard, electronic drum pad, key pad, touch pad, button interface, or other musician interface for providing digital control signals to input 20. Sound waveform source 22 is preferably a mass storage device such as a hard disk drive, optical disk drive, tape source, floppy disk drive (e.g. zip), or other memory device. Sound waveform source 22 stores a wide range of digital samples of one or more musical instruments. For example, sound waveform source 22 can store approximately 1100 independent digital waveform signals associated with a grand piano. The independent waveforms signals are representative of the 88 keys of the piano played at 6 variations of timbre in stereo (e.g., $88\times6\times2=1056$). The number of waveform signals can be adjusted for various applications and instruments. The discussion of the use of system 10 to reproduce sounds of a grand piano is not for a limiting purpose and is merely discussed as an example. The types of notes, types of sources, types of instruments, and size of samples are discussed only in an exemplary fashion in this patent application.

System 10 can be implemented on a PC platform, as an embedded system, as a music synthesizer, as a dedicated rack mount music sampler, or as another sound generation device. Preferably, system 10 is a computer based system comprised of a CPU, a hard disk drive and a host memory. The CPU is configured by software to perform the operations of audio processor 12 described throughout the present application. Alternatively, system 10 can be a dedicated digital signal processor system, a dedicated general purpose processor system, or a hardware system. The host memory is preferably at least 32 megabytes of DRAM, although other types of solid state memory can be used. The host memory can be combinations of ROM, SRAM, flash memory or other devices. The CPU is preferably a 486 or above processor.

System 10 is configured to provide digital waveform samples or signals stored in source 22 in real time, e.g., without audio perceivable delay, at output 28. As the musician manipulates sound selection source 18, audio processor 12 provides digital output signals representative of those manipulations at output 28 without an audio perceivable latency between the manipulation of source 18 and the hearing the music from speaker system 26. Preferably, audio processor 12 is able to provide the digital output signals in less than 15 milliseconds (e.g., 8 or 5 milliseconds or less) from the manipulation of source 18.

The term an audio perceivable delay, as used in this application, refers to a loss of continuity, an objectionable latency, a stall, or a detainment of the music or sound as heard by the human ear. The term audio perceivable delay is used in two different contexts. The first context is related to the time difference discussed above between a musician's actuations and the production of sound. The second context is related to the continuity of signals between the first part and remaining parts of the digital waveform signals. Also, the second context is related to the continuity of signals between portions of the remaining parts of the digital waveform signals. The second context requires that the delay be less than several micro-seconds (e.g., so that there is no lose of continuity) to prevent noise artifacts, which are detectable by the human ear. System parameters and application criteria can affect the definition of audio perceivable delay and the acceptability of the latency. Most preferably, there is no delay between portions of digital waveform signals as they are provided at output 28.

Due to the configuration of audio processor 12, system 10 can advantageously utilize a slower speed, lower cost, mass storage device as source 22 (e.g., a hard disk drive), and yet provide digital output signals at output 28 in a sufficient amount of time. The use of source 22 to store the bulk of the digital waveform signals greatly reduces the size of the solid state memory (not shown) required by processor 12 (e.g., and hence the cost of processor 12) for real time production of sound. Unlike conventional synthesizer systems which download all of the digital waveform signals from source 220 into solid state memory, processor 12 utilizes a caching system so that most of the digital waveform signals are not stored in the solid state memory of processor 12. Most portions of the digital waveform signals are only stored in solid state memory when actually needed.

More particularly, processor 12 utilizes its solid state memory (not shown) to store only a first portion of each of the digital waveform signals stored in source 22. When the musician selects a particular instrument, processor 12 downloads the first portion for each digital waveform signal stored for the selected instrument. Alternatively, the musician may choose a portion of an instrument or several instruments, and processor 12 can download a first portion of each digital waveform in accordance with the musician's choice. Therefore, the first portions of digital waveforms signals stored in the solid state memory of audio processor 12 preferably correspond on a one-to-one basis to the digital waveform signals stored on source 22 for a selected instrument or group of instruments.

Once the solid state memory of audio processor 12 is loaded with the first portions, audio processor 12 responds to the digital control signals provided at input 20. Audio processor 12 provides the first portions of a selected digital waveform signal from its solid state memory to output 28 in response to the digital control signal provided at input 20. Preferably, at least the first 0.5 seconds of the digital waveform signal is stored in the solid state memory. The remaining portions of the selected digital waveform signal are then provided from source 22 to processor 12 and to output 28. The remaining portions can be retrieved while the first portion is being played. The remaining portion can include portions of the digital waveform signals representing up to three minutes or more of sound. Therefore, processor 12 utilizes a caching mechanism to reduce or eliminate an audio perceivable delay or loss of continuity between providing a first portion of digital waveform signals stored in solid state memory and remaining portions stored in source 22.

Figure 2:
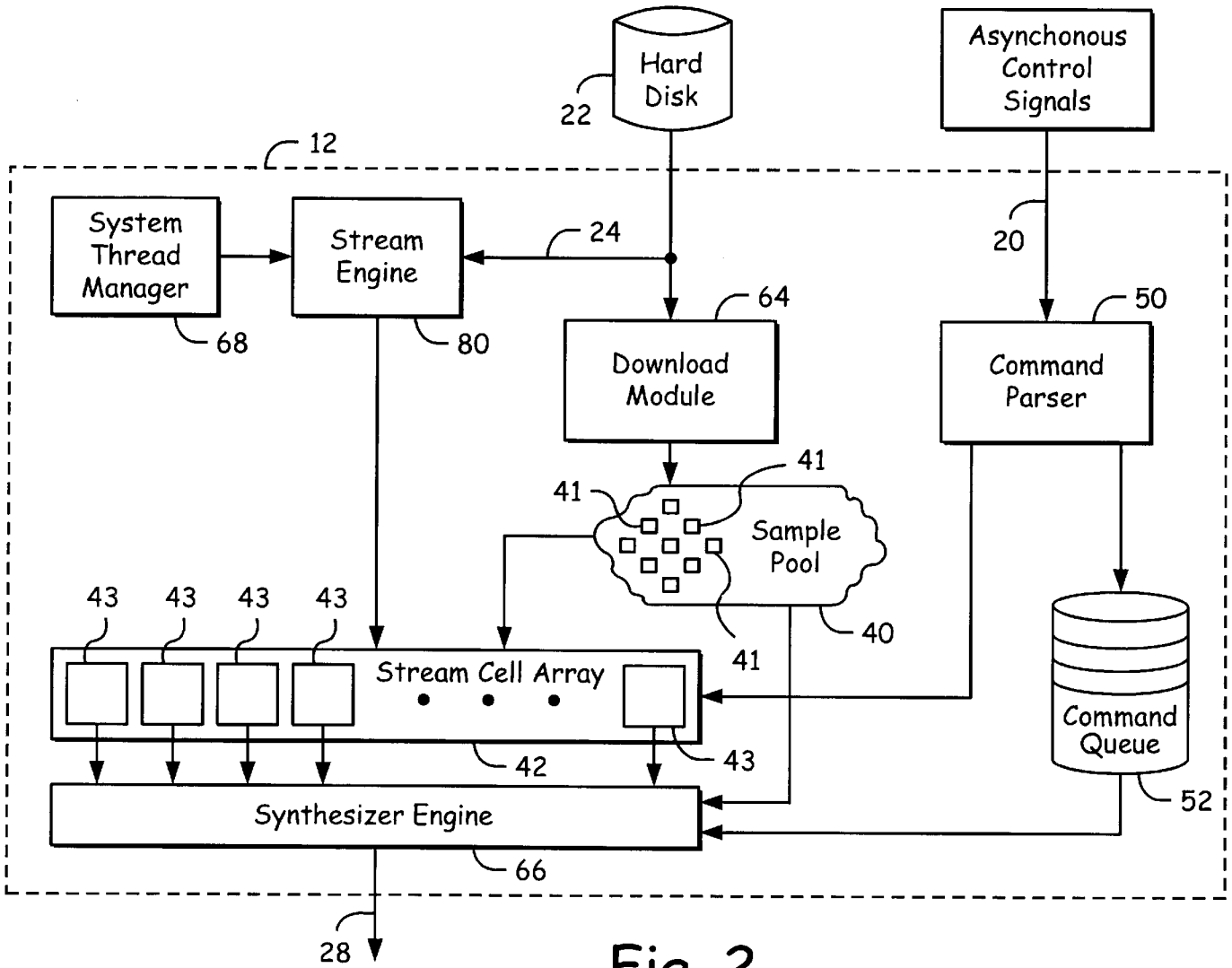
FIG. 2 is a more detailed block diagram showing the audio processor, illustrated in FIG. 1, including a stream engine, an array of stream buffer cells, and a sample pool including sample pool cells.
Figure 3:
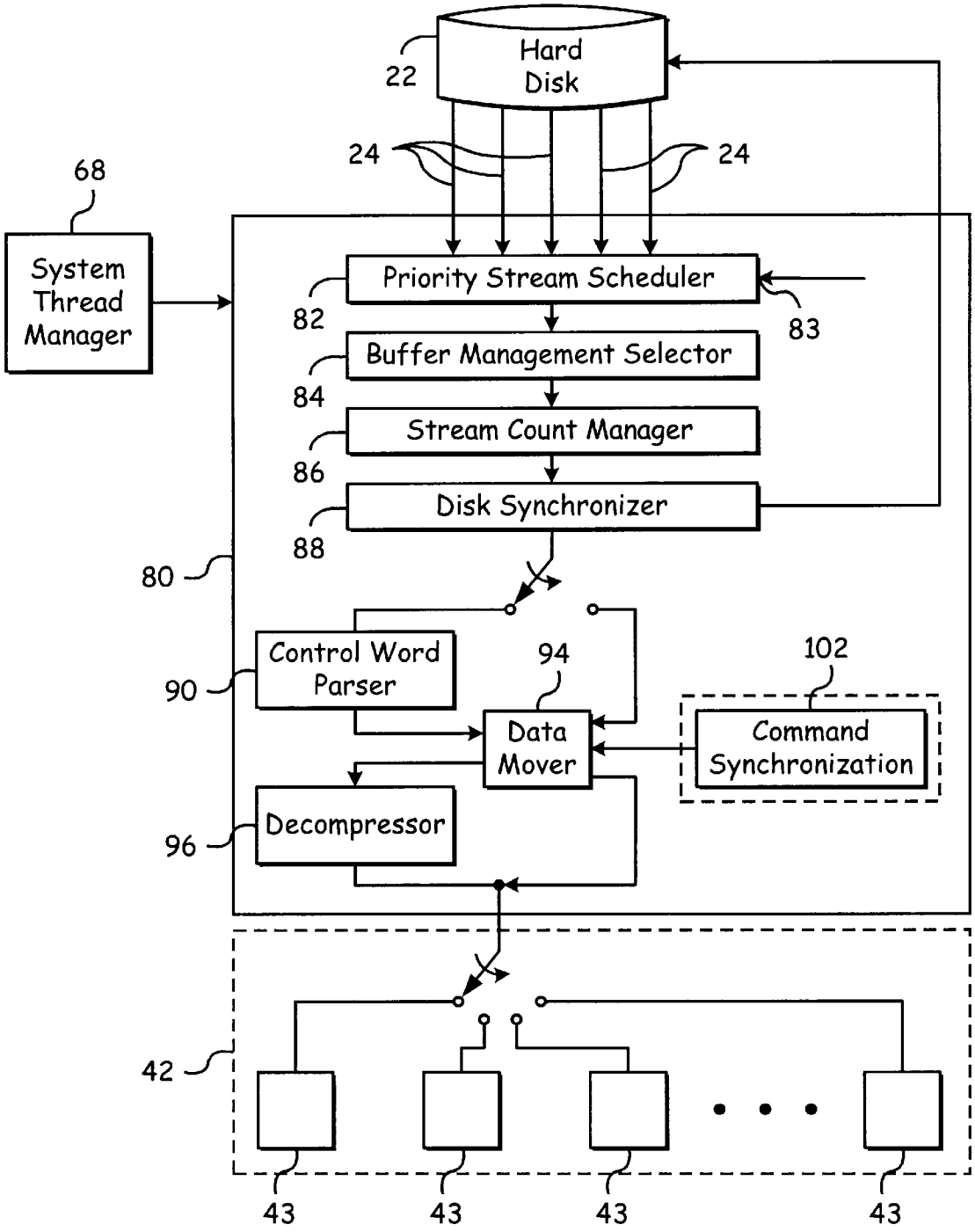
FIG. 3 is a more detailed block diagram of the stream engine illustrated in FIG. 2.

With reference to FIG. 2, audio processor 12 has input 24 coupled to source 22 which is shown in FIGS. 2 and 3 as a hard disk drive. Audio processor 12 includes a sample pool 40, an array 42 of stream cells 43, a command parser 50, a command queue 52, a synthesizer engine 66, a download module 64, a system thread manager 68, and a stream engine 80. Command parser 50 is coupled to input 20 and command queue 52. Command queue 52 is coupled to a control input of synthesizer engine 66.

Input 24 is coupled to download module 64 and stream engine 80. Download module 64 is coupled to sample pool 40. Sample pool 40 is comprised of a plurality of sample pool cells 41. Sample pool cells 41 are provided for each of digital waveform signals for a particular instrument, portion of an instrument, or group of instruments selected by the musician. Sample pool 40 is configurable for a various number of cells. In the grand piano example, pool 40 has approximately 1100 cells 41.

Stream engine 80 is also coupled to system thread manager 68. System thread manager 68 operates as a master to stream engine 80. Manager 68 ensures that stream engine 80 receives the necessary amount of operational time of the CPU (not shown) utilized to implement processor 12 by cooperating with the operating system of the computer. Manager 68 preferably keeps stream engine 80 consistently active as the CPU operates in a multi-tasking environment such as the Windows® environment.

The operations of manager 68, engine 66, engine 80, module 64, and parser 50 are preferably implemented by the CPU of the PC platform (not shown). The storage operations of array 42, pool 40 and queue 52 are provided by the host memory for the PC platform.

Figure 4:
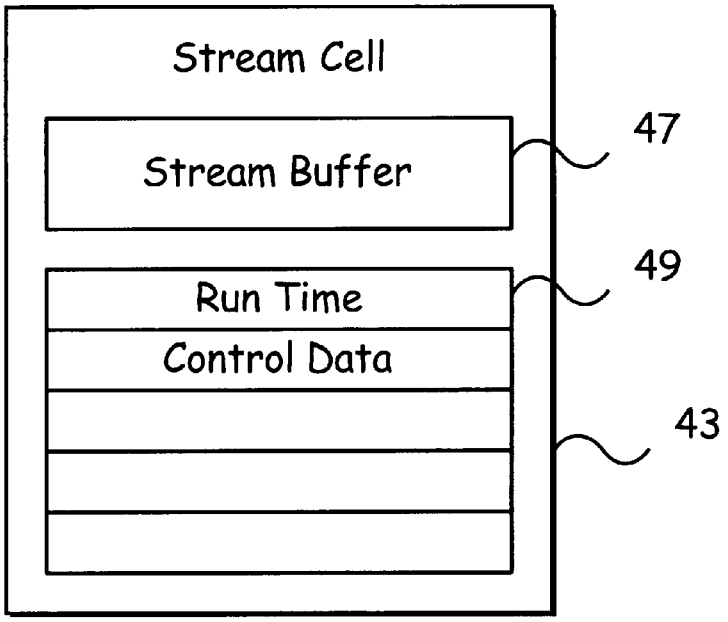
FIG. 4 is a block diagram of one of the stream buffer cells illustrated in FIG. 2.

Stream engine 80 is also coupled to array 42. Stream engine 80 is capable of providing portions of digital waveform signals from source 22 to stream cell array 42. The portions of the digital waveform signals are stored in cells 43 of cell array 42. With reference to FIG. 4, each of cells 43 includes a stream buffer 47 and a run-time control data buffer 49. Stream cell array 42 is preferably scalable from approximately 24 to 256 cells although any size of array 42 is possible. Each of cells 43 represents a single voice or stream of polyphony where two voice polyphony is representative of a concurrent musical tone (e.g., the combination of a C and E note). Therefore, a one-to-one voice to stream cell 43 relationship is utilized by processor 12.

Stream engine 80 manages the flow of data or portions of digital waveform signals into stream cell array 42. Engine 80 maintains streams of data or portions of signals from source 22 to cells 43. The streams of data can be up to the number cells 43 and can be maintained as virtual streams from source 22.

Stream engine 80 is preferably a state machine configured to move portions of digital waveform signals from source 22 to array 42 so processor 12 can create sound in a real time or near real time fashion. As stream engine 80 provides the portions of digital waveform signals to cells 43 in array 42, synthesizer engine 60 consumes the portion of digital waveform signals in cells 43 and provides a digital waveform output representative of a selected sound at output 28.

As stream engine 80 fills cells 43 in array 42 with portions of the digital waveform signals, stream engine 80 provides synchronization and error correction, and decompression operations such as a lossless second order decompression on the signals. Although stream engine 80 is shown and described in the application as a throughput from input 24 to array 42 for discussion purposes, stream engine 80 in actuality moves data from source 22 to array 42 (e.g., performs more of a transmission management operation of signals from source 22 to array 42).

When an instrument or group of instruments or portion thereof is selected by the musician, download module 64 receives a first part for each of the digital waveform signals for the particular instrument from source 22. Download module 64 stores the first part of the digital waveform signals in sample cells 41 of sample pool 40. Alternatively, the first part of the digital waveform signals can be permanently stored in pool 40 or received from another source (not shown).

Figure 5:
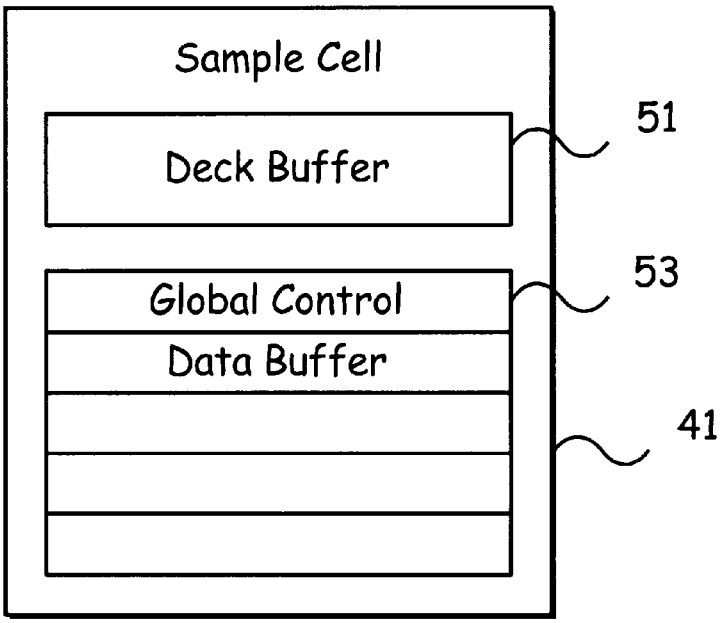
FIG. 5 is a block diagram of one of the sample pool cells illustrated in FIG. 2.

With reference to FIG. 5, sample pool cells 41 in sample pool 40 (FIG. 2) include a deck buffer 51 and a global control data buffer 53. Preferably, deck buffer 51 of sample cells 41 stores the first 0.5 seconds (approximately 64K bytes depending on characteristics of system 10 such as RAM size, CPU speed and hard disk speed) of each of the digital waveform signals. Of course, smaller samples can be stored if source 22 and engine 80 can provide signals to array 42 more quickly.

Global control data buffer 53 includes control information or global control data. Global control data refers to control data for a particular sample. Global control data is available to system 10 at load time. Global control data provides system 10 with characteristics of the sample, or digital waveform signal, including the sampling rate, the length of the sample, the playback parameters and control words for compression algorithms. The control words are used to decompress the particular packets or portions of the digital waveform signals.

Memory space can be saved by using a pointer (not shown) in buffer 49 of cells 43 which merely addresses the corresponding deck buffer 51 in pool 40, rather than storing the first portion of the digital waveform signal in cells 43. Similarly, memory space can be saved by providing pointer (not shown) which merely points to global control data buffer 53.

In operation, when digital control signals such as MIDI control signals are provided at input 20, parser 50 manages the allocation of all new stream cells 43. Parser 50 responds to the asynchronous digital control signals at input 20 to reference stream cells 43 back to the appropriate sample cell 41. Parser 50 manages the allocation and deallocation of the active stream cells 43 in response to on/off messages received at input 20. For example, as a musician strikes a key, an event is sent to parser 50 to turn on a particular sample cell 41. Parser So finds the appropriate cell 41 from the sample pool 40, based on the velocity at which the key was struck along with current state of the synthesizer system 10. Parser 50 is responsible for allocating a stream cell 43 from the available cells 43 in array 42.

Parser 50 first, searches for an unused stream cell 43. Parser 50 uses the run-time control data stored in buffer 49 of a stream cell 43 to determine its availability. In the case that all stream cells 43 are allocated, parser 50 uses the following rules to determine which stream cell 43 is to be preempted:

1. If applicable, parser 50 looks for a voice with identical characteristic as the new voice. For example, if a middle C on the keyboard is currently being played, and the musician hits another middle C when system lo is at maximum polyphony, the parser 50 will preempts the older middle C, in favor of the newer middle C.
2. Parser 50 finds the voice (e.g., cell 43) with the lowest run-time volume value in buffer 49, and selects it as the preempted voice.

Parser 50, on allocating a stream cell 43, sets the run-time control data in buffer 49. The run-time control data references a single sample cell 41. The run-time control data also signals both stream engine 80 and synthesizer engine 66 to begin processing this particular cell 43. On allocation of a new voice, parser 50 is responsible for initializing of stream cells 43.

Likewise, parser 50 passes all control signals through to the synthesizer engine 66, via the command queue 52. These commands allow engine 66 to control the playback experience as defined by industry accepted standards, such as the MIDI 1.0 specification. For example, the natural termination of voice can be signaled when a musician releases a key on an instrument. This off signal allows the synthesizer engine 66 to naturally decay the active voice in manner which is consistent with the sounds of an acoustic instrument.

Parser 50 initializes the run-time control data by flagging it as a "new voice". The flag is used in conjunction with the stream engine 80 for priority scheduling and error correction. Parser 50 also initializes the progress counter for a new voice/stream cell 43. This progress counter is maintained by stream engine 80 and synthesizer engine 66 for priority scheduling and stream data integrity.

Parser 50 initializes the run-time control data in buffer 49 to point to deck buffer 51 in the associated sample cell 41. In addition, parser 50 sets the stream buffer 47 corresponding to the stream cell 43. Synthesizer engine 66 then begins processing out of deck buffer 51. As data is consumed from deck buffer 51, stream engine 80 begins filling stream buffer 47 of cell 43. Eventually, synthesizer engine 66 consumes all the data available in deck buffer 51. Engine 66 dynamically switches its internal pointer to begin consuming data from stream buffer 47 of cell 43 once all the data in buffer 51 is consumed. Engine 66 signals stream engine 80 by setting the appropriate flag in the run-time control data and advancing the progress counter.

With reference to FIG. 3, stream engine 80 is shown having input 24 coupled to source 22. Engine 80 is also coupled to system thread manager 68. An output of stream engine so is coupled to array 42 of cells 43.

Stream engine 80 includes a priority stream scheduler 82, a buffer management selector 84, a stream count manager 86, a disk synchronizer 88 having a control output coupled to source 22, a control word parser 90, a data mover 94, and a decompressor 96. Data mover 94 is also coupled to a command synchronization circuit 102 from command parser 50.

Stream engine 80 is responsible for supplying data from source 22 to active stream cells 43, while maintaining the real-time integrity of the sample audio (e.g., digital output signal). Engine 80 acts as the producer to the individual cell 43, whereas synthesizer engine 66 acts as the consumer. Synthesizer engine 66 and stream engine 80 are coupled by the run-time control data, which is initialized by parser 50 when a new voice is allocated. The run-time control data guarantees audible integrity out of the entire system 10 by ensuring that the consumer (e.g., engine 66) and producer (e.g., engine 80) of data always remain in synchronization.

Stream engine 80 supplies data to n-channels (e.g., n cells 43), where n is the current polyphony level. The data is streamed from source 22 to stream buffer 47 of the appropriate stream cell 43. The order of processing multiple stream cells 43 is determined at run-time by priority stream scheduler 82. Priority stream scheduler 82 is based off a priority level scheduling mechanism. Cells 43 are dynamically assigned a priority level. Cells 43 are handled with the highest levels processed first. The priority levels are assigned to cells 43 based on the current position of the data stream. When a new voice is allocated, the data stream is initialized to the starting position on source 22. The particular cell 43 is assigned a new stream position. stream/cells 43 flagged with a new stream position are given the highest priority in system 10. If there are multiple cells 43 with the new stream flag set, then a round-robin method is implemented.

Stream cells 43 that do not have the new flag set are prioritized based on the progress counter which is a component of the run-time control data in buffer 49. This counter will be incremented when a single quadrant of data has been consumed from the stream buffer 47 by the synthesizer engine 66. The priority levels are determined by the value of the progress counter. This counter is initialized to zero by parser 50 when a new voice has been allocated. In the case where multiple cells 43 have the same priority levels, a round-robin scheduler is implemented.

Stream engine 80 is a state machine, which is given control of system 10 via the system thread manager 68. System thread manager 68 is responsible for allocating all remaining bandwidth of the host processor, (not shown) to stream engine 80.

Priority stream scheduler 82 determines which, if any, stream cell 43 needs to be processed next. When an appropriate stream cell 43 has been tagged for processing, control is passed to buffer management selector 84. The buffer management selector 84 initializes the transfer from source 22 to a stream buffer 47, based on the currently used buffer scheme. To guarantee real-time accuracy for a variety of hardware systems, system 10 implements two different buffering schemes. The choice of buffering scheme is a function of the system parameters, including CPU bandwidth, speed of source 22 (including data access time and seek time). System 10 employs two buffering schemes: a single quadrant transfer and a double quadrant transfer.

All stream buffers 47 in cells 43 can be viewed as four quadrants. Synthesizer engine 66 consumes data on a quadrant by quadrant basis. Each time a quadrant is consumed the progress counter is incremented. Stream engine 80 fills stream buffer 47 either a single quadrant or a double quadrant at a time, depending on the buffering scheme currently deployed. Stream engine 80 is potentially maintaining n streams of real-time data that may be segmented across source 22, where n is the polyphony of system 10. In accessing multiple streams, two parameters are of concern to the efficient utilization of source 22, set-up time (e.g., seek time), and data rate. Every time a stream cell 43 needs to be processed, system 10 incurs the cost of a set-up time. System 10 uses disk synchronizer as to set-up the source 22 from the correct location for the current stream. In a double quadrant buffering scheme, over the life of the stream, the accumulated time required to set-up the stream will be half of the time required when using the single quadrant buffer.

The negative to using the double quadrant buffering scheme is that each time a cell 43 needs to be processed, twice as much data must be moved from the source 22 to the stream buffer 47. Because stream engine 80 maintains a single thread of execution when processing the stream cells 43, if a single cell 45 maintains control of source 22 for too long, other streams have the potential to starve. The buffering scheme for a particular stream cell 43 is stored in the run-time control data buffer 49. Stream count manager 80 manages the progress counter for the purpose of indicating the current status of stream engine 80 for any given stream cell 43. The progress counter is used by synthesizer engine 66 as a method to signal the stream engine 80 for more data. Likewise, the progress counter can be used to indicate that data is available.

After the buffer management selector 84 has chosen the appropriate buffering scheme, disk synchronizer 80 sets up source 22 by issuing a command to move the reading apparatus to the correct location on source 22. The exact location on source 22 for any stream cell 43 is maintained in the run-time control data buffer 49. The run-time control data is updated on each pass through the stream manager 80.

System 10 accounts for compressed data. Any compression algorithm can be implemented. However, for the application of musical tone generation a lossless scheme is preferably implemented. The lossless algorithm guarantees that quality does not degrade due to the compression/decompression process. The musical samples will be compressed prior to storage in source 22. This embodiment implements a second order differential compression/decompression algorithm. The decompression of a stream is handled by a decompressor 96. The compressed stream is packetized. Each packet contains a signal control word, which is used as a control data for decompressor 96. The control words are initially stored with the instrument on source 22. When an instrument is loaded into system 10, download module 64 transfers the control words from the source 22 to the global control data buffer 53 in cells 41 of pool 40. The decompression algorithm can accept various packet sizes, providing they are of a $2^n$ size. The size of the packet offsets the compression ratio of the sampled instrument. This embodiment use 2 kiloword packet sizes.

The data mover is responsible for directing the sampled instrument from source 22 to either the second order decompressor 96 or the stream buffer 47. Before the data is moved, command synchronization module 102 executes. Module 102 is responsible for handling any error correction and all synchronization between the stream engine 80 and parser 50. The command synchronization 102 handles the previously discussed preemption of stream cell 43. If a stream cell 43 is prematurely deallocated because system 10 has hit maximum polyphony and a new voice has been started, then stream engine 80 must check the integrity of the active stream cell 43 before proceeding. This situation is a result of stream is engine 80 and parser 50 running asynchronously.

With referenced FIG. 2, system 10 can be configured to provide the first part of digital waveform signals stored in deck buffer 51 of cells 41 and pool 40 to cells 43 in array 42 rather than directly providing the first part from pool 40 to output 28 through synthesizer engine 66. In this method, engine 80 or engine 66 moves the first part of the digital waveform signal from pool 40 to cell 43 in array 42. Synthesizer engine 66 then moves the first part of the digital waveform signal from cell 43 of array 42 to digital output 28.

Deck buffer 45 is preferably comprised of 64K bytes. Stream buffer 47 is preferably comprised of from two to four quadratures of 32 Kilobytes (Kb). Control buffer 49 is comprised of 200 bytes. source 22 preferably has a seek time of approximately 7 milliseconds (ms) and a data rate of 8–12 MB/S, although other times are possible. Source 22 is preferably a one gigabyte or more hard disk drive.

It is understood that, while the detailed drawings, specific examples and particular component values given describe a preferred exemplary embodiment of the present invention, they are for the purpose of illustration only. The apparatus and method of the invention is not limited to the precise details and conditions disclosed. For example, although the system is utilized as a software configured computer based synthesizer, other hardware and software schemes can be utilized. Further, although specific memory sizes and time periods are discussed, they are discussed only for the purpose of illustration. Further, single lines in the various drawings may represent multiple conductors. Various changes made to the details disclosed without departing from the spirit of the invention which is defined by the following claims.

What is claimed is:

1. An audio processor for providing a digital output signal representative of a sound at an output, the audio processor comprising:

a mass storage device input for receiving a plurality of digital waveform signals;

a control input for receiving digital control signals, the digital control signals being indicative of at least one selected digital waveform signal of the digital waveform signals; and a control circuit coupled to the control input and the mass storage device input, the control circuit storing a first part of the digital waveform signals in a host memory, the control circuit providing from the host memory the first part of the selected digital waveform signal to the output in response to the digital control signals and subsequently providing a second part of the selected digital waveform signal from the mass storage device input to the output.

2. The audio processor of claim 1 wherein the host memory includes a stream buffer and a sample pool, wherein the sample pool stores the first part of the digital waveform signals and wherein the control circuit first provides the first part of the selected digital waveform signal to the stream buffer in response to the digital control signals and subsequently provides the second part of the selected digital waveform signal from the mass storage device input to the stream buffer.

3. The audio processor of claim 2 wherein the control circuit first provides the first part of the selected digital waveform signal from the sample pool to the output and subsequently provides the second part of the selected digital waveform signal from the stream buffer to the output.

4. The audio processor of claim 1 wherein the host memory includes a stream buffer and a sample pool, wherein the sample pool stores the first part of the digital waveform signals and wherein the control circuit first provides the first part of the selected digital waveform signal to the stream buffer in response to the digital control signals and provides the first part of the selected digital waveform signal from the stream buffer to the output and after the first part of the selected digital waveform signal is provided to the stream buffer, the control circuit provides the second part of the selected digital waveform signal from the mass storage device input to the stream buffer and provides the second part of the selected digital waveform signal from the stream buffer to the output.

5. The audio processor of claim 1 wherein the host memory includes a stream buffer and a sample pool, wherein the sample pool stores the first part of the digital waveform signals, and wherein the control circuit further comprises:

a stream engine coupled to the mass storage device input and to the stream buffer;

a synthesizer engine coupled to the stream buffer and the output, wherein the synthesizer engine provides the first part of the selected digital waveform from the sample pool to the output and the stream engine provides the second part of the selected digital waveform from the mass storage device input to the stream buffer, and the synthesizer engine provides the second part of the selected digital waveform from the stream buffer to the output.

6. The audio processor of claim 5 wherein the control circuit further comprises:

a command parser coupled to the stream engine, the command parser building an event list including a plurality of selected digital waveform signals, the stream engine reading the event list and providing second parts of the selected digital waveform signals from the mass storage device input and to the stream buffer.

7. The audio processor of claim 6 wherein the stream buffer is comprised of a plurality of stream buffer cells, each stream buffer cell storing at least a portion of one of the selected digital waveform signals.

8. The audio processor of claim 7 wherein each stream buffer cell is comprised of a deck buffer pointer storing an address of the first part of the selected digital waveform, a stream control data buffer for storing control data related to the selected digital waveform, and a stream buffer Unit for storing the portion of the selected digital waveform.

9. The audio processor of claim 8 wherein the sample pool includes a plurality of sample cells, each of the sample cells including a deck buffer storing the first part of the digital waveform signals, and a sample control data buffer for storing control data related to the digital waveform signals.

10. The audio processor of claim 9 wherein the control circuit includes a download module, the download module receiving the first part of the digital waveform signals from the mass storage device input and storing the first part of the digital waveform signals in the sample deck buffer.

11. The audio processor of claim 10 wherein the download module receives control data associated with the digital waveform signals from the mass storage device input and stores the control data in the sample control data buffer.

12. The audio processor of claim 1 wherein the control circuit includes a system thread manager for ensuring that the stream engine is active an appropriate amount of time.

13. The audio processor of claim 12 wherein the control circuit is operated in a multi-tasking environment.

14. A digital synthesizer system, comprising:

a mass storage device means for storing a plurality of digital waveform signals, each of the digital waveform signals corresponding to a particular sound of a plurality of sounds;

a control input means for receiving a digital control signal, the digital control signal being indicative of a selected sound of the sounds;

a host memory means for storing a first part for each of the digital waveform signals; and a processor means for providing from the host memory the first part of the digital waveform signal corresponding to the selected sound to the output, and for providing a second part of the digital waveform signal corresponding to the selected sound from the mass storage device means to the output.

15. The digital synthesizer system of claim 14 wherein the processor means is a CPU operating in a operating system environment.

16. The digital synthesizer of claim 14 wherein the host memory is a DRAM device.

17. The digital synthesizer of claim 14 wherein the mass storage device means is an optical disk drive, tape drive, hard disk drive, or floppy disk drive.

18. The digital synthesizer of claim 14 wherein the host memory means includes a sample pool for storing the first part and a stream buffer for temporarily the second part before the processor means provides the second part to the output.

19. A method of digitally synthesizing sounds in a synthesizer system, the synthesizer system including a mass storage device, a host memory, and a processor, the mass storage device storing a plurality of digital waveform, signals, the processor having a digital control signal input and a digital output, the processor being coupled to the host memory and the mass storage device, the method comprising:

downloading a first part for each of the digital waveform signals into the host memory;

receiving a digital control signal on the digital control signal input, the digital control signal indicating a selected digital waveform signal of the digital waveform signals;

providing the first part of the selected digital waveform signal from the host memory to the digital output; and providing a second part of the selected digital waveform, signal from the mass storage device to the digital output.

20. The method of claim 19 wherein the providing the first part step includes storing the first part in a stream buffer in the host memory and providing the first part from the stream buffer to the digital output.

21. The method of claim 20 wherein the, providing the second part step includes storing the second part in the stream buffer in the host memory and providing the second part from the stream buffer to the digital output.

22. The method of 21 wherein the stream buffer is comprised of a plurality of stream cells and the providing the first part step includes storing the first part in a deck section of a stream cell.

23. The method of 22 wherein the stream buffer the providing the second part step includes storing the second part in a stream section of the stream cell.

24. A method of digitally synthesizing sounds in a synthesizer system, the synthesizer system including a mass storage device, a host memory, and a processor, the mass storage device storing a plurality of digital waveform, signals, each of the digital waveform signals corresponding to a particular sound of a plurality of sounds, a first part for each of the digital waveform, signals being stored in the host memory, the processor having a digital control signal input and a digital output, the processor being coupled to the host memory and the mass storage device, the method comprising:

receiving a digital control signal on the digital control signal input, the digital control signal indicating a selected sound of the plurality of sounds;

providing a first part of a digital waveform signal corresponding to the selected sound from the host memory to the digital output; and providing a second part of the digital waveform signal from the mass storage device to the digital output corresponding to the selected sound.

25. The method of claim 24 wherein the providing the first part step includes storing the first part in a stream buffer in the host memory and providing the first part from the stream buffer to the digital output.

26. The method of claim 25 wherein the providing the second part step includes storing the second part in the stream buffer in the host memory and providing the second part from the stream buffer to the digital output.

27. The method of 26 wherein the stream buffer is comprised of a plurality of stream cells and the providing the first part step includes storing the first part in a deck section of a stream cell.

28. The method of 27 wherein the stream buffer the providing the second part step includes storing the second part in a stream section of the stream cell.

29. The method of claim 24 wherein the digital control signal is a MIDI signal.

30. The method of claim 24 wherein the processor is operating in a Windows® environment.

31. A recording and playback workstation for recording sound samples and playing back stored sound samples, the played back sound samples being mixed together and filtered to provide a multiplicity of sound combinations and effects, the recording and playback workstation comprising:

a mass storage device storing a plurality of digital waveform signals;

a solid state memory system including a first buffer and a second buffer, the first buffer storing a first part of the digital waveform signals;

a stream engine coupled to the mass storage device and to the solid state memory system, the stream engine providing a second part of the digital waveform signals from the mass storage device to the second buffer;

at least one output for providing a waveform signal;

a synthesizer engine coupled to the second buffer, the first buffer, and the output; and at least one control input for receiving signals corresponding to the recall, mixing, and filtering of the stored digital waveform signals;

wherein the synthesizer engine combines and processes the first part of the digital waveform signals and the second part of the digital waveform signals according to the control inputs and communicates the signals to the output.

32. The recording and playback workstation of claim 31, wherein the solid state memory system is a DRAM system.

33. The recording and playback workstation of claim 32, wherein the storage medium is a rotatable storage medium.

34. At The recording and playback workstation of claim 33, wherein the mass storage device is a hard disk drive.

35. The recording and playback workstation of claim 33, wherein the mass storage device is a removable hard disk drive.

36. The recording and playback workstation of claim 33, wherein the mass storage device is a readable/writable optical drive.

37. The recording and playback workstation of claim 35, wherein the memory system includes random access memory (RAM) devices.

38. The recording and playback workstation of claim 37, wherein there are at least thirty-two (32) locations in the first buffer.

39. The recording and playback workstation of claim 38, wherein the memory system includes dynamic random access memory (RAM) devices.

40. The recording and playback workstation of claim 39, wherein the second buffer operates as a circular buffer.

41. The recording and playback workstation of claim 40, wherein at least one of the at least one control inputs is a musical instrument digital interface (MIDI) input.

42. The recording and playback workstation of claim 41, wherein at least one of the at least one control inputs is a keyboard.

43. The recording and playback workstation of claim 42, wherein the keyboard is a computer keyboard.

44. An audio processor for providing a digital output signal representative of a sound at an output, the audio processor comprising:

a mass storage device for providing a plurality of digital waveform signals;

a control input device for receiving digital control signals, the digital control signals being indicative of at least one selected digital waveform signal of the digital waveform signals; and a control circuit coupled to the control input and the mass storage device input, the control circuit storing a first part of the digital waveform signals in a host memory, the control circuit providing from the host memory a first part of the selected digital waveform signal to the output in response to the digital control signals and providing a remaining part of the selected digital waveform signal from the mass storage circuit to the output, whereby the control circuit continuously stores the first part of the selected digital waveform signal and stores the remaining part of the selected digital waveform signal with a caching scheme.

45. The audio processor of claim 44, wherein the host memory includes a stream buffer and a sample pool, wherein the sample pool stores the first part of the digital waveform signals and wherein the control means first provides the first part of the selected digital waveform signal to the stream buffer in response to the digital control signals and subsequently provides the remaining part of the selected digital waveform signal from the mass storage device input to the stream buffer.

46. The audio processor of claim 45, wherein the control circuit first provides the first part of the selected digital waveform signal from the sample pool to the output and subsequently provides the remaining part of the selected digital waveform signal from the stream buffer to the output, the stream buffer being utilized as a circular buffer to provide the remaining part.

47. The audio processor of claim 44, wherein the host memory includes a stream buffer and a sample pool, wherein the sample pool stores the first part of the digital waveform signals and wherein the control circuit first provides the first part of the selected digital waveform signal to the stream buffer in response to the digital control signals and provides the first part of the selected digital waveform signal from the stream buffer to the output and after the first part of the selected digital waveform signal is provided to the stream buffer, the control circuit provides the remaining part of the selected digital waveform signal from the mass storage device means to the stream buffer and provides the remaining part of the selected digital waveform signal from the stream buffer to the output.

48. The audio processor of claim 44, wherein the host memory includes a stream buffer and a sample pool, wherein the sample pool stores the first part of the digital waveform signals, and wherein the control means further comprises:

a stream engine coupled to the mass storage device input and to the stream buffer;

a synthesizer engine coupled to the stream buffer and the output, wherein the synthesizer engine provides the first part of the selected digital waveform from the sample pool to the output and the stream engine provides the remaining part of the selected digital waveform from the mass storage device input to the stream buffer, and the synthesizer engine provides the remaining part of the selected digital waveform from the stream buffer to the output.

49. The audio processor of claim 48, wherein the control circuit further comprises:

a command parser coupled to the stream engine, the command parser building an event list including a plurality of selected digital waveform signals, the stream engine reading the event list and providing remaining parts of the selected digital waveform signals from the mass storage device input and to the stream buffer.

50. The audio processor of claim 49, wherein the stream buffer is comprised of a plurality of stream buffer cells, each stream buffer cell storing at least a portion of one of the selected digital waveform signals.

51. The audio processor of claims 50, wherein each stream buffer cell is comprised of a deck buffer pointer storing an address of the first part of the selected digital waveform, a stream control data buffer for storing control data related to the selected digital waveform, and a stream buffer unit for storing the portion of the selected digital waveform.

52. The audio processor of claim 51, wherein the sample pool includes a plurality of sample cells, each of the sample cells including a deck buffer storing the first part of the digital waveform signals, and a sample control data buffer for storing control data related to the digital waveform signals.

53. The audio processor of claim 52, wherein the control circuit includes a download module, the download module receiving the first part of the digital waveform signals from the mass storage device means and storing the first part of the digital waveform signals in the sample deck buffer.

54. The audio processor of claim 53, wherein the download module receives control data associated with the digital waveform signals from the mass storage device input and stores the control data in the sample control data buffer.

55. The audio processor of claim 44, wherein the control circuit includes a system thread manager for ensuring that the stream engine is active an appropriate amount of time.

56. The audio processor of claim 55, wherein the control circuit is operated in a multi-tasking environment.

57. A digital synthesizer system, comprising:

a mass storage device means for storing a plurality of digital waveform signals, each of the digital waveform signals corresponding to a particular sound of a plurality of sounds;

a control input means for receiving a digital control signal, the digital control signal being indicative of a selected sound of the sounds;

a host memory means for storing a first part for each of the digital waveform signals; and a processor means for generating a digital sound signal at an output, the processor means providing from the host memory the first part of the digital waveform signal corresponding to the selected sound to the output and providing a second part of the digital waveform signal corresponding to the selected sound from the mass storage device means to the output, whereby the processor means utilizes a caching technique to provide the second part to the output.

58. The digital synthesizer system of claim 57, wherein the processor means is a CPU operating in an operating system environment.

59. The digital synthesizer of claim 57, wherein the processor means utilizes a priority scheduling mechanism to handle the second part of the selected sound in a priority order with respect to other sounds.

60. The digital synthesizer of claim 57, wherein the mass storage device means is an optical disk drive, tape drive, hard disk drive, or floppy disk drive.

61. The digital synthesizer of claim 57, wherein the host memory means includes a sample pool for storing the first part and a stream buffer for temporarily storing the second part before the processor means provides the second part to the output.

* * * * *